US005513927A

United States Patent [19]

Baker et al.

[11] Patent Number: 5,513,927

[45] Date of Patent: May 7, 1996

[54] BRIDGE JOINT CONSTRUCTION

[76] Inventors: Richard J. Baker, 4508 Bromley La., Richmond, Va. 23221; Bruce W. Adams, 5631 Teterling Ct., Chester, Va. 23831

[21] Appl. No.: 283,515

[22] Filed: Aug. 1, 1994

[51] Int. Cl.[6] ..... E01C 11/02

[52] U.S. Cl. ..... 404/47; 404/74

[58] Field of Search ..... 404/47, 74, 69, 404/87, 72; 52/396

[56] References Cited

U.S. PATENT DOCUMENTS 4,324,504 4/1982 Cottingham et al. ..... 404/74

5,024,554 6/1991 Benneyworth et al. ..... 404/74

*Primary Examiner*—William P. Neuder

*Attorney, Agent, or Firm*—Don Halgren

[57] ABSTRACT

The present invention is directed to an improved bridge joint and method for constructing a bridge joint in a channel or trench over an expansion gap in a bridge. The invention utilizes a Batron elastomer binder, which may be provided at room temperature and poured over aggregate chips in the channel, even in adverse weather conditions. The resulting mixture of Batron elastomer binder and aggregate withstands vehicular impact stress and provides adhesion and improved elasticity.

13 Claims, 2 Drawing Sheets

BRIDGE JOINT CONSTRUCTION

The present invention is directed to bridge joint construction, and more particularly to a method for constructing an improved bridge joint within a channel at an expansion gap between adjacent structural members of the bridge deck.

BACKGROUND OF THE INVENTION

Bridges typically comprise a plurality of discrete structural members supported on pillars and disposed end to end with an expansion gap between adjacent members to provide the bridge deck surface or roadway.

Cracking and deterioration of the roadway and structural members is a common problem at bridge joint regions. Vehicular impact above the expansion or contraction due to changes in weather conditions, contribute to this cracking and deterioration. Also, cracks and potholes are formed in the roadway that are hazardous to drivers and lead to further deterioration of the supporting bridge structure. This and other problems with bridge joints are more fully set forth in U.S. Pat. No. 5,024,554 to Baker et al.

Previous attempts to overcome the well-known problems associated with bridge joints have achieved limited success. The methods for sealing bridge joints proposed in both U.S. Pat. No. 4,324,504 to Cottingham and U.S. Pat. No. 5,024,554 to Baker et al. require the application of a hot binder to aggregate in the channel. Further, the heated binder would not bond properly if installed on a cold day or under wet weather conditions. Moreover, even if the binder material was properly heated and installed during optimal weather conditions, the elasticity of the resulting bridge joint was generally limited to less than two inches of movement for a bridge joint twenty inches wide.

The elastomer binder employed in the present invention has not to Applicants' knowledge been previously used to construct bridge joints. Rather, it has been used to fill cracks or joints between slabs in the roadway. Consequently, the combination of a Batron elastomer binder of the present invention, and aggregate chips to transfer vehicular stress and to withstand movement of adjacent support members is believed to be novel.

Moreover, the design considerations are significantly different for constructing bridge joints as opposed to filling other joints or cracks in the roadway. For example, these other joints are much more narrow and often more shallow than bridge joints and thus are not required to withstand the same magnitude of vehicular impact stress. Further, the structural members of a bridge are directly exposed to dynamic changes in weather conditions, but structural members beneath a roadway are typically insulated by the ground. Consequently, bridge joints are frequently subject to more extreme contraction and expansion from weather conditions than are other joints. As a result of these unique design considerations and to the best of Applicant's knowledge, the Batron elastomer binder has not been combined with aggregate when used to fill these other joints. Therefore, the qualities of the Batron elastomer binder, when used in combination with aggregate to fill a bridge joint, were heretofore unknown.

SUMMARY OF THE INVENTION

The present invention is directed to an improved method for constructing a bridge joint over an expansion gap in a bridge or parking structure. The invention overcomes the problems and limitations of the prior art by using a Batron elastomer binder in combination with aggregate for constructing bridge joints, rather than a conventional binder such as polyurethane or silicone. The Batron elastomer binder may be maintained at room temperature up to the time at which it is applied to the aggregate in the channel, so no additional equipment is required for heating the binder. Further, the binder and aggregate mixture of the present invention has superior elasticity such that the bond between the binder and the aggregate chips allow for movement in excess of four inches in a bridge joint eight inches wide.

Accordingly, it is a primary object of the present invention to provide a method of constructing a bridge joint having increased elasticity to withstand the movement of the bridge deck members while maintaining the physical integrity of the joint.

It is a further object of this invention to provide a method of constructing a bridge joint that can be performed despite traditionally adverse weather conditions because of the use of a Batron elastomer as the binder material.

It is yet a further object of this invention to provide a method of constructing a bridge joint that, because of the use of a Batron elastomer as the binder material, can be performed without the traditional expense of costly equipment for heating the binder material.

It is also an object of this invention to provide a method for constructing a bridge joint having improved capability for transferring vehicular impact stress throughout the joint while maintaining the physical integrity of the joint.

To accomplish these and other related objects of the invention, in one aspect the invention involves a method for constructing a bridge joint which utilizes a Batron elastomer binder in combination with heated aggregate to form a bridge joint having increase elasticity and the capability for transferring vehicular impact stress throughout the joint without compromising the integrity of the bond between the aggregate chips and the binder. In another aspect, the invention involves a bridge joint formed in a channel or trench over an expansion gap, where the bridge joint comprises the mixture of a plurality of aggregate chips and a Batron elastomer binder.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
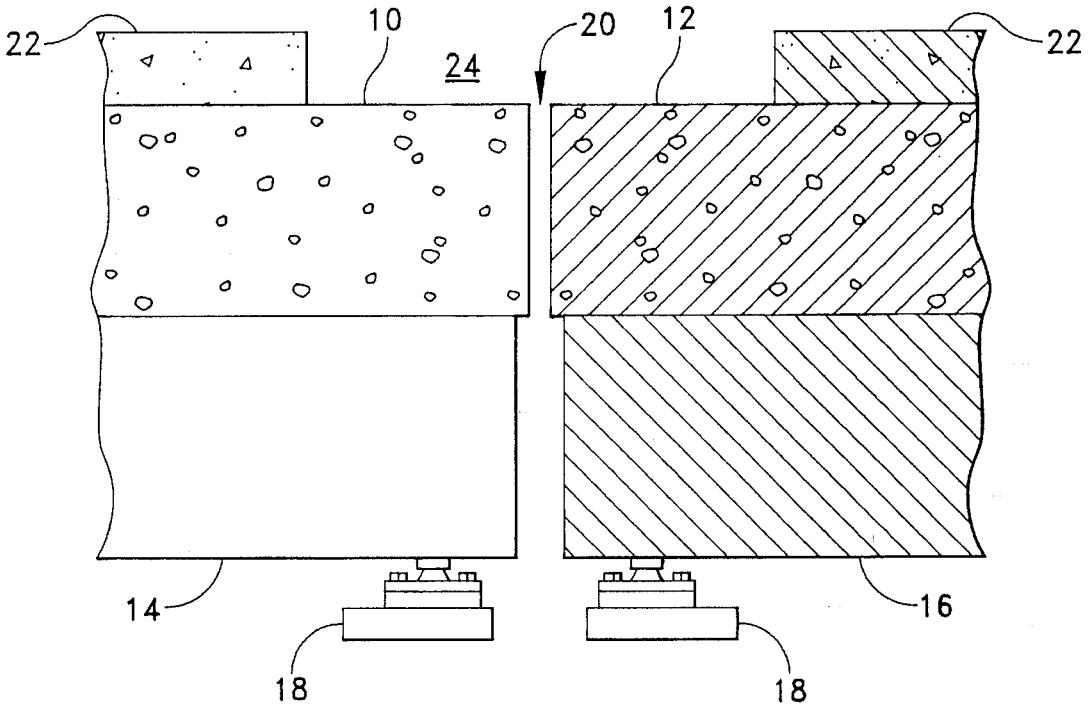
FIG. 1 is a side elevation view of a channel formed at an expansion gap between adjacent structural members of a bridge.

Referring now to the drawings in greater detail and initially to FIG. 1, a typical bridge comprises a series of end to end structural members, such as a slab 10 and a slab 12, supported by a series of end to end girders, such as a girder 14 and a girder 16. Similarly, the girders are supported by support members such as a pillars 18, which extend from ground level to the elevated position of the slabs they support. Typically, adjacent structural members, such as girders 14 and 16, are supported at opposite ends across the width of the bridge. Thus, a second pillar, not shown in FIG. 1, would also support girders 14 and 16.

Adjacent structural members, including slabs 10 and 12 and girders 14 and 16, are spaced apart such that a gap 20 exists between the members. The gap 20 accommodates normal movement of the members such as contraction and expansion due to temperature variations. Although a single gap 20 is shown in FIG. 1, it will be understood that most bridges comprise a plurality of such gaps, where the number of gaps corresponds to the number of junctions between adjacent structural members.

A roadway comprising a layer 22 of bituminous paving material is normally placed as a continuous band of uniform thickness extending from one end of the bridge to the other and across the gaps 20 at each junction between adjacent members. The layer 22 also extends across the entire width of the bridge. A portion of the layer 22 shown in FIG. 1 has been cut and removed to create a channel 24 in which a bridge joint may be constructed. The top of channel 24 is defined by the adjacent portions of layer 22. The bottom of channel 24 is defined by the top of slabs 10 and 12.

The term "bridge joint" is sometimes used in the art of bridge joint construction to mean the zone of juncture between bridge members which may move relative to one another. That term is also used to mean the material of the roadway proximal the juncture of bridge members. The term "bridge joint" is used in both senses in this application and those skilled in the art will have no difficulty in differentiating between the meanings to be given the term from the context in which the term is used. Further, the term "joint" is used in this application to mean a joint or crack in the roadway other than a bridge joint.

Figure 2:
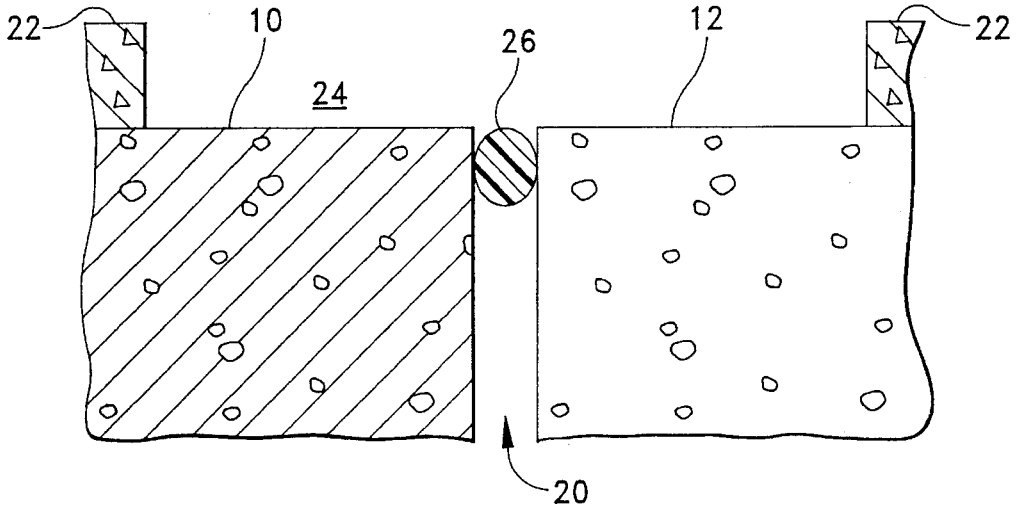
FIG. 2 is an enlarged fragmentary side elevation view of the channel of FIG. 1 with a backer rod inserted at the expansion gap.
Figure 3:
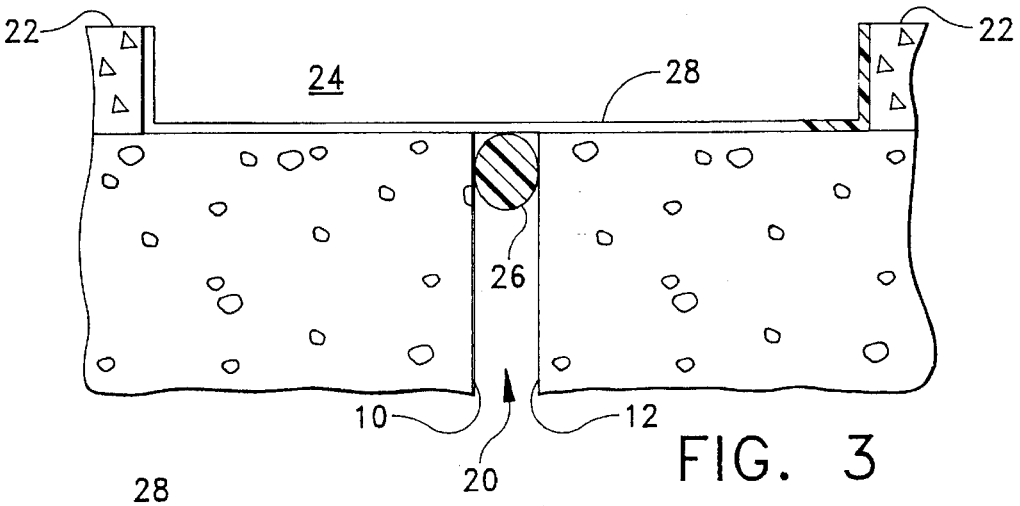
FIG. 3 is a view similar to FIG. 2 illustrating a layer of primer applied in the channel.
Figure 4:
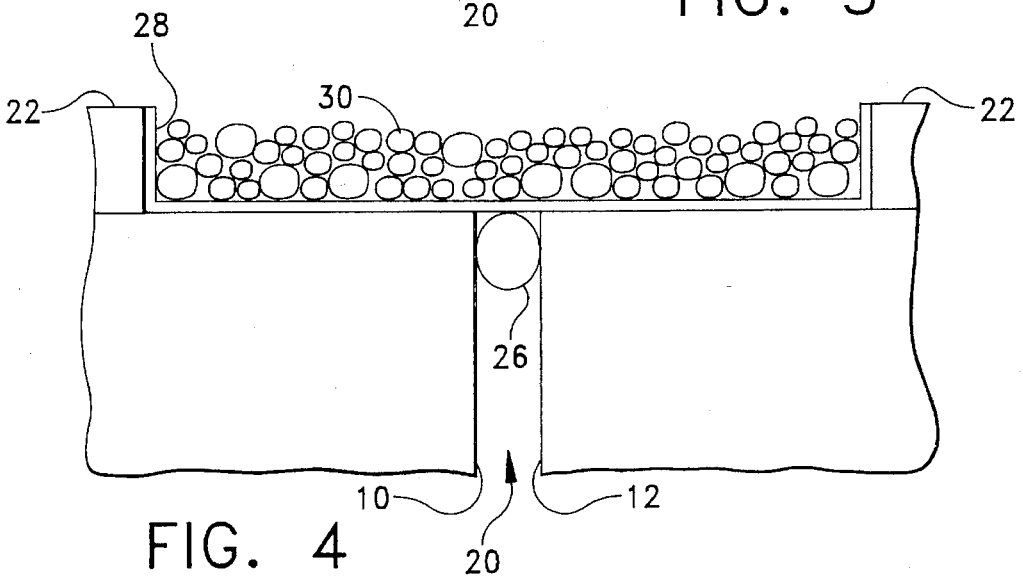
FIG. 4 is a view similar to FIG. 3 illustrating aggregate chips placed in the channel.

Turning to FIGS. 2–4, an oversized cylindrical backer rod 26 is fitted in gap 20 just below channel 24. Next, a primer 28 is applied to the channel 24 so that a thin film of primer 28 is uniformly distributed on the sides and bottom of channel 24. Then, a plurality of aggregate chips 30 are placed in channel 24 until the top layer of chips is substantially one-quarter inch below the top of channel 24. One of ordinary skill in the art of bridge joint construction can readily identify satisfactory materials for backer rod 26 and can select an acceptable primer 28 and an appropriate type and size of aggregate chips 30.

Figure 5:
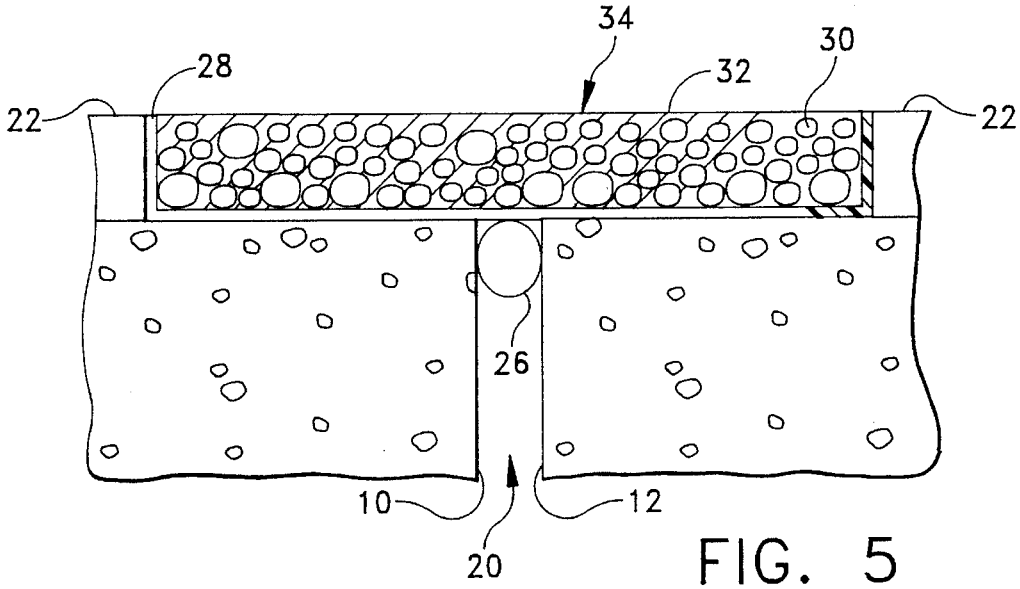
FIG. 5 is a view similar to FIG. 4 illustrating a completed bridge joint formed with a mixture of aggregate and a Batron elastomer binder.

Referring to FIG. 5, a Batron elastomer binder 32 is applied to the aggregate chips 30 located in channel 24. As the binder 32 is poured into the channel 24, a binder and aggregate mixture 34 is formed. The binder 32 is applied until the mixture 34 reaches substantially one-quarter inch from the top of the channel 24.

The particular composition of the binder 32, which allows for cold binder application, adhesion and increased elasticity, is formed by blending two component compositions: a catalyst, referred to hereinafter as Component A, and a liquid Batron polymer, hereinafter referred to as Component B. The blend ratio for Components B:A ranges from approximately 80:20 to approximately 92:8, with the blend ratio of a preferred embodiment being approximately 89:11.

The preferred ranges for the ingredients of Component A are as follows, wherein the percentages shown represent percentage by weight:

| | |
|---|---|
| Water | 10–85% |
| Sodium Bichromate | 10–50% |
| Saniicizer 261 | 5–65% |
| Igepal 710 | 0.2–2% |
| Sulfur | 0.2–5% |
| Fillers | 0–60% |

The sodium bichromate is prepared into a solution with water or another suitable solvent to form a sodium bichromate solution. This solution is used as the curing agent for a liquid Batron polymer, one of the ingredients in Component B. While the quantity of sodium bichromate may vary within the stated ranges, there should be a minimum quantity of water in the range of 10–15% in order to properly dissolve the sodium bichromate.

Santicizer 261, or alkyl benzyl phthalate, is a nonvolatile plasticizer which works to prevent Component A from hardening. This plasticizer is sold under the trade name Santicizer 261 by the Monsanto Company of St. Louis, Miss. Igepal 710, an ethoxylated methyl phenol, is a nonionic surfactant used in preparing an emulsion of the water and the Santicizer 261. This surfactant is made commercially available under the trademark Igepal 710 by the GAF Corporation of New York, N.Y. The sulfur is added to Component A and acts as a curing agent when Component A and Component B are blended together.

The fillers for Component A, referenced in the table above, include C-325 Limestone, carbon black, and Cab-O-Sil M5. It is recognized that these ingredients operate to enhance the commercial desirability of Component A, but are not essential ingredients of the composition. C-325 Limestone, or calcium carbonate, is used as an extender to allow the composition to obtain a greater volume. Carbon black is a finely divided form of carbon, and is used in this composition as a colorant to give Component A a black color. Cab-O-Sil M5, or silicone dioxide (amorphous), is used as a thickening agent to increase viscosity and reduce separation and settling of Component A. Silicone dioxide is sold under the name Cab-O-Sil M5 by the Cabot Corporation of Kokomo, Ind.

The preferred ranges for the ingredients of Component B are as follows, wherein the percentages shown represent percentage by weight:

| | |
|---|---|
| 6649 | 5–80% |
| Santicizer 261 | 5–45% |
| LP-32 | 15–30% |
| Fillers | 0–70% |

LP-32 is a Polysulfide liquid, know under the tradename "Batron" polymer (grade 32) which, when Component A is blended with Component B, converts the resulting composition into a solid rubber mass. Polysulfide is a tradename of Morton International, of Chicago, Ill. The Batrob LP-32 can be used in the range of 15–30%, as listed above, without a significant change in the properties of the ultimate binder material and is available from Bridgesaver, Inc. of Richmond Va.

6649 is an internal blend of coal tar pitch and creosote. The coal tar is used to improve adhesion (and to lower the cost). The creosote, which is a coal tar derivative, is used to reduce the viscosity of the coal tar. The internal blend of 6649 comprises a coal tar: creosote ratio from approximately 50:50 to approximately 90:10. In a preferred embodiment where 6649 represents 25.64% of Component A, the preferred coal tar: creosote ratio is 20.00:5.64. As indicated above, the quantity of 6649 should be at least 5% of Component B. If, however, the fillers are removed from the composition, the quantity of 6649 can be as high as approximately 60–80%.

As discussed above for Component A, Santicizer 261, or alkyl benzyl phthalate, is a non-volatile plasticizer which operates to prevent Component B from hardening. The fillers referenced above for Component B are C-325 Limestone and Dixie Clay. Dixie Clay, or hydrated aluminum silicate, is a filler and reinforcing agent for rubber and plastics that is made available under the name Dixie Clay by the Vanderbilt Company of Norwalk, Conn. C-325 Limestone is used as an extender in Component B. Neither Dixie Clay nor limestone are essential to Component B, but they are desirable as commercially significant additives.

A preferred composition for Component A is as follows, wherein the percentages shown represent percentage by weight:

| | |
|---|---|
| Water | 13.84% |
| Igepal 710 | 0.71% |
| Sodium Bichromate | 23.65% |
| Santicizer 261 | 17.16% |
| Sulfur | 1.18% |
| C-325 Limestone | 41.40% |
| Carbon Black | 0.58% |
| Cab-O-Sil M5 | 1.48% |

A preferred composition of Component B is as follows, wherein the percentages shown represent percentage by weight:

| | |
|---|---|
| 6649 | 25.64% |
| Santicizer 261 | 20.95% |
| LP-32 | 20.00% |
| Dixie Clay | 11.62% |
| C-32 Limestone | 21.79% |

The preferred embodiments of Component A and Component B and the preferred blend of ingredients for commercial purposes. In many cases, however, varying the percentages listed above or substituting certain other ingredients will not substantially alter the performance characteristics of the resulting bridge joint. Such variations and substitutions are contemplated as being with the scope of the present invention. In addition to the nonessential ingredients, some of which are identified above, other materials capable of serving the same purpose as the listed ingredients could be substituted for each of these ingredients. Thus, the ingredients that serve as extenders (e.g. C-325 Limestone and Dixie Clay) may be replaced by other suitable filler materials. Further, water may be replace by alcohol, and sulfur may be replaced by some other activator for rubber compounding.

It will be understood that the most critical ingredients in Components A and B are LP-32, sodium bichromate, water, sulfur, and 6649. Although certain materials may be substituted for some of these ingredients, the function performed by each of these ingredients is essential to the ultimate performance of the resulting binder material when constructing a bridge joint.

The present invention consists of a number of conventional steps in constructing a bridge joint, but the use of the polysulfide elastomer binder allows certain steps to be added, modified or even rendered unnecessary. When constructing the first bridge joint over a particular expansion gap, a channel 24 must be cut out of the roadway layer 22. When replacing an existing bridge joint, however, a new channel may be cut or the existing channel may be used again after the old bridge joint is removed.

A bridge joint channel is generally four to eight inches wide and one to four inches deep, and its length is approximately equal to the width of the roadway on the bridge. A typical channel might be six inches wide and three inches deep. The channel 24 should be cleaned before bridge joint construction commences, such as by sand cleaning or blasting, or any other known means of cleaning a bridge joint channel. FIG. 1 illustrates a channel 24 that has been prepared for the commencement of bridge joint construction.

Once the channel 24 has been cleaned, a flexible backer rod 26 is placed in gap 20 just below channel 24 (as shown in FIG. 2) and across the width of the roadway. Backer rod 26 should be slightly oversized so that it fits tightly into gap 20 and prevents liquid from exiting channel 24. In a preferred embodiment, rod 26 is composed of a closed cell, non-gassing foam material capable of withstanding elevated temperatures such as a polyethylene material. The backer rod 26 may be installed before cleaning the channel if desired.

As shown in FIG. 3, a thin coat of primer 28 is sparingly painted on the sides and bottom of channel 24. Thus, a thin and substantially uniform film of primer 28 is applied within the channel. The purpose of the primer is to treat the surface of the channel so as to promote adhesion of the binder to the channel. A preferred embodiment of the present invention utilizes an epoxy primer for non-porous surfaces such as steel and a polyurethane primer for porous surfaces, but one skilled in the art of bridge joint construction might select another commercially available primer having substantially the same qualities.

About fifteen minutes after primer 28 has been applied, the aggregate chips 30 may be placed in channel 24. Granite is the preferred aggregate for the present invention, but limestone or other aggregate would also be satisfactory. The aggregate chips 30 are typically heated to about 120 degrees Fahrenheit before being placed in channel 24 to allow the bridge joint to cure more quickly. The chips 30 may be dried and heated by spreading the aggregate 30 out on the ground and directing a propane torch at the chips 30 as they are being raked. Alternatively, a concrete mixer, or any other known means, may be used to dry and heat the chips 30. When the ambient temperature is 70 degrees Fahrenheit, it has been found that chips 30 can be heated to 120 degrees Fahrenheit in less than an hour. Once the aggregate is heated, the channel 24 is filled up to substantially one-quarter of an inch below the top of the surrounding pavement 22 with the chips 30.

The aggregate chips 30 may be of varying size or of uniform size but it has been found that improved performance in a typical bridge joint may result from using fifty percent one-half inch aggregate chips and fifty percent three-quarter inch aggregate chips. It is theorized that the equal dispersion of these differently sized chips 30 increases the number of voids between chips while reducing the size of the voids that would result from using uniformly sized chips. This theory is based on the premise that smaller chips will occupy portions of the voids otherwise existing between larger chips. Moreover, increasing the number of voids and reducing the size of the voids is believed to improve the performance of the bridge joint for withstanding vehicular stress, for adhesion and for elasticity. The distance that a chip must travel to transfer the stress to another chip is reduced because the voids are smaller. Further, the entire bridge joint can sustain increased movement of the adjacent structural members because each void is responsible for a relatively smaller displacement of chips. Voids between the chips 30 may also be referred to as cavities or interstices. As those skilled in the art will appreciate, the depth of the bridge joint may proscribe the use of certain sizes of aggregate chips.

Next, a liquid Batron polymer composition (e.g. Component B) and a catalyst (e.g. Component A) are each provided at a temperature between sixty and ninety degrees Fahrenheit and mixed together for several minutes. It has been found that optimal bridge joint performance will result if these components are provided at room temperature, and preferably at seventy degrees Fahrenheit. Room temperature for the purposes of the present invention refers to temperature range from approximately sixty degrees Fahrenheit to approximately eighty degrees Fahrenheit. The two components should be provided with no more than a five degree difference in temperature between the components. In a preferred embodiment, the Batron polymer component and the catalyst are manually squeezed out of glandular plastic containers and into a single container. The Batron polymer (Component B) is placed in the mixing container first, then the catalyst is added. The Batron polymer and catalyst should be mixed mechanically (such as by a high viscosity mixer adaptable for a standard power drill) for between five and ten minutes, eight minutes being preferred, for proper curing of the resulting Batron elastomer binder 32.

After mixing the Batron polymer and the catalyst, the resulting binder 32 may be poured into the channel 24 over the top of the aggregate chips 30 in a smooth, controlled manner. It is not necessary to agitate the binder and aggregate mixture within the channel. Rather, gravity allows the binder 32 to fill the voids created between the chips 30 such that individual chips are spaced apart from one another. Unlike prior art binders, the Batron elastomer binder 32 may be applied in traditionally adverse weather conditions. Previously, bridge joint construction at near-freezing temperatures or when exposed to precipitation would adversely affect the curing of the bridge joint. As a result, satisfactory bridge joints could only be constructed during fewer than half of the days of the year in many geographical locations, thereby causing both expected and unexpected delays in bridge joint construction. However, a bridge joint can be successfully constructed in accordance with the method of the present invention in wet/damp conditions and/or in temperatures at least as low as approximately 40 degrees Fahrenheit.

The Batron elastomer binder 32 has a syrup-like consistency, and it has been found that a trench that is about eight inches wide and three inches deep will accommodate eight to eleven pounds of an equal mixture of one-half inch and three-quarter inch aggregate chips per linear foot. The same trench will accept approximately three-quarters to one gallon of the binder 32 per linear foot in addition to the aggregate chips. In the preferred embodiment, the aggregate chips 30 will occupy from approximately 50% to approximately 75% of the resulting bridge joint by both weight and volume.

If there will be traffic over the trench before it fully cures, a thin layer of dry sand is sometimes placed over the mixture 34 to minimize tracking. Alternatively, a woven paving geo-fabric, which wears off eventually, may be placed over the mixture 34 for the same purpose. The term "curing" as used in this application does not refer to the technical definition of curing, which may take as long as a week for a bridge joint constructed in accordance with the present invention. Rather, the term "curing" as used in this application means "tack-free".

When a vehicle travels over the bridge joint, the impact stress from the vehicle is transferred throughout the joint. More particularly, a downward force from the vehicle is transferred from chip to chip from the top of the bridge joint to the bottom of the bridge joint. The vehicular stress is carried by both large and small chips until it reaches the relatively incompressible upper surface of a bridge support member at the bottom of the bridge joint. In this way, the present invention allows the aggregate chips within the bridge joint to withstand vehicular impact stress without disrupting the bond between the binder and the chips.

From the foregoing, it will be seen that this invention is one well adapted to attain all the ends and objects hereinabove set forth together with other advantages which are obvious and which are inherent to the structure.

It will be understood that certain features and sub combinations are of utility and may be employed without reference to other features and sub combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A bridge joint constructed within a channel at an expansion gap between adjacent structural members, said bridge joint comprising:

a plurality of aggregate chips, there being a plurality of interstices between said chips; and a room temperature elastomer binder occupying said plurality of interstices between said chips, wherein said elastomer binder is unheated when poured over the aggregate chips.

2. The bridge joint of claim 1, wherein said plurality of aggregate chips further comprises a plurality of smaller chips and a plurality of larger chips.

3. The bridge joint of claim 2, wherein said smaller chips are one-half inch in size.

4. The bridge joint of claim 3, wherein said larger chips are three-quarters of an inch in size.

5. The bridge joint of claim 4, wherein said smaller chips and said larger chips each occupy approximately on half of the volume of said plurality of aggregate chips.

6. The bridge joint of claim 1, wherein said elastomer binder comprises the mixture of a liquid polymer component and a catalyst component.

7. The bridge joint of claim 6, wherein said liquid polymer component comprises between fifteen and thirty percent liquid polymer.

8. A method for constructing a bridge joint within a channel at an expansion gap between adjacent structural members, said method comprising the steps of:

heating a quantity of aggregate;

placing the heated aggregate in the channel until said aggregate approaches substantially one-quarter inch from the top of the channel; and applying a Batron elastomer binder at room temperature, over said aggregate to form a mixture of aggregate and binder in the channel.

9. The method of claim 8, wherein said elastomer binder is formed by mixing a liquid polymer component and a catalyst component.

10. The method of claim 9, wherein said liquid polymer component comprises between fifteen and thirty percent liquid Batron polymer.

11. A method for constructing a bridge joint within a channel at an extension gap between adjacent structural members, said method comprising the steps of:

installing a flexible backer rod in the expansion gap to prevent leakage from the channel into the gap;

priming the channel with a film of primer material;

heating a quantity of aggregate;

placing the heated aggregate into the channel until the top layer of aggregate is substantially one-quarter of an inch below the top of the channel;

providing a Batron elastomer binder at room temperature; and pouring said Batron elastomer binder at room temperature over the heated aggregate to substantially fill the channel.

12. The method of claim 11, wherein said elastomer binder is formed by mixing a liquid polymer component and a catalyst component.

13. The method of claim 12, wherein said liquid polymer component comprises between fifteen and thirty percent liquid Batron polymer.

* * * * *